US006674240B1

(12) United States Patent
Gärtner et al.

(10) Patent No.: US 6,674,240 B1
(45) Date of Patent: Jan. 6, 2004

(54) GAS DISCHARGE LAMP COMPRISING AN OXIDE EMITTER ELECTRODE

(75) Inventors: Georg Gärtner, Aachen (DE); Wilem Jacobus Van Den Hoek, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 284 days.

(21) Appl. No.: 09/716,875

(22) Filed: Nov. 20, 2000

(30) Foreign Application Priority Data

Nov. 23, 1999 (DE) ..... 199 56 322

(51) Int. Cl.[7] ..... H01J 61/04; H01J 17/04
(52) U.S. Cl. ..... 313/633; 313/311
(58) Field of Search ..... 313/633, 311; 252/500–521.6

(56) References Cited

U.S. PATENT DOCUMENTS 5,654,606 A * 8/1997 Weijtens et al. ..... 313/491
5,847,498 A * 12/1998 Mehrotra et al. ..... 313/352

FOREIGN PATENT DOCUMENTS

DE 4415748 C2 11/1995 ..... H01J/61/067

* cited by examiner

*Primary Examiner*—Edward J. Glick
*Assistant Examiner*—Elizabeth Gemmell
(74) *Attorney, Agent, or Firm*—Frank J. Keegan

(57) ABSTRACT

A gas discharge lamp, in particular a low-pressure gas discharge lamp, comprising an electrode including a carrier of an electrode metal and a first electrode coating of an electron-emitting material, which material comprises a metal powder preparation of a powder of a reducing metal selected from the group formed by aluminum, silicon, titanium, zirconium, hafnium, tantalum, molybdenum, tungsten and the alloys thereof, which metal powder preparation is provided with a powder coating containing a noble metal selected from the group formed by rhenium, cobalt, nickel, ruthenium, palladium, rhodium, iridium and platinum, and the alloys thereof, and said material comprising at least one alkaline earth metal oxide selected from the group formed by calcium oxide, strontium oxide and barium oxide, is characterized by a uniform emission current and a long service life.

6 Claims, 1 Drawing Sheet

GAS DISCHARGE LAMP COMPRISING AN OXIDE EMITTER ELECTRODE

FIELD OF THE INVENTION

The invention relates to a gas discharge lamp, in particular a low-pressure gas discharge lamp, which comprises an electrode including a carrier of an electrode metal and an electrode coating of an electron-emitting material, which material comprises a metal powder and at least one alkaline earth oxide selected from the group formed by calcium oxide, strontium oxide and barium oxide.

BACKGROUND OF THE INVENTION

The generation of light in a gas discharge lamp is based on the ionization, and the resulting electric discharge, of the atoms of the filling gas in the lamp when an electric current flows through the lamp. The electrodes of the lamp emit electrons, which are so strongly accelerated by the electric field between the electrodes that, upon colliding with the gas atoms, they are capable of exciting and ionizing the latter. When the gas atoms return to the ground state, as in the case of the recombination of electrons and ions, a more or less substantial part of the potential energy is converted to radiation.

The amount of electrons that can be emitted by the electrodes depends upon the work function of the electrodes for electrons. Tungsten, which is customarily used as the electrode metal, has itself a comparatively high work function. For this reason, the electrode metal is customarily coated with a material which mainly serves to improve the electron-emitting properties of the electrode metal. It is typical of the electron-emitting coating materials of electrodes in gas discharge lamps that they contain an alkaline earth metal, either in the form of the alkaline earth metal oxide or in the form of an alkaline earth metal-containing starting compound (precursor) for the alkaline earth metal oxide.

Thus, conventional low-pressure gas discharge lamps are generally provided with electrodes which are composed of tungsten wires with an electron-emitting coating containing oxides of the alkaline earth metals calcium, strontium and barium. To manufacture such an electrode, a tungsten wire is coated, for example, with the carbonates of the alkaline earth metals in a binder preparation. During evacuating and baking out the lamp, the carbonates are converted into the oxides at temperatures of approximately 1000° C. After this burn-off of the electrode, the electrode already supplies a noticeable emission current which, however, is not stable yet. Next, an activation process is carried out. As a result of this activation process, the originally non-conducting ion lattice of the alkaline earth oxides is converted to an electronic semiconductor by incorporating donor-type imperfections into the crystal lattice of the oxides. These imperfections essentially consist of elementary alkaline earth metal, for example calcium, strontium or barium. The electron emission of such electrodes is based on this mechanism of imperfections. The activation process serves to provide a sufficient quantity of excess, elementary alkaline earth metal, enabling the oxides in the electron-emitting coating to supply as much emission current as possible at a prescribed heating capacity.

As regards the function of these electrodes and the service life of the lamp, it is important that elementary alkaline earth metal is constantly available. The reason for this being that the electrode coating continuously loses alkaline earth metal during the service life of the lamp, which is partly caused by the fact that the electrode coating evaporates slowly, and partly by the fact that the electrode coating is sputtered off by the ionic current in the lamp.

The elementary alkaline earth metal is initially dispensed continuously by a reduction of the alkaline earth oxide at the tungsten wire during operation of the lamp. However, this dispensation stops when the tungsten wire is passivated, in the course of time, by a high-impedance interface of tungsten oxide, alkaline earth silicate or alkaline earth tungstate.

To improve the reduction of barium oxide to elementary barium in a fluorescent lamp, it is known from DE 44 15 748 that the electron-emitting substance comprises, in addition to alkaline earth mixed carbonate and zirconium oxide, 3 to 15 wt.% of a reducing metal powder having a high melting point, said reducing metal powder being selected from at least one metal of the group composed of tantalum, niobium, tungsten and molybdenum, and the electron-emitting substance is distributed such that it fills the whole winding core of the coil including the two terminal windings of the multi-section coil of incandescent wire.

However, like the electrode carrier wire, the metal powders of tantalum, niobium, tungsten or molybdenum are surrounded in the course of time with a passivating interface of tungsten oxide, alkaline earth silicate or alkaline earth tungstate, or of the corresponding niobium, tantalum or molybdenum compounds.

SUMMARY OF THE INVENTION

It is an object of the present invention to provide a gas discharge lamp with an extended service life and an improved emission current.

In accordance with the invention, this object is achieved by a gas discharge lamp comprising an electrode including a carrier of an electrode metal and a first electrode coating of an electron-emitting material, which material comprises a metal powder preparation of a powder of a reducing metal selected from the group formed by aluminum, silicon, titanium, zirconium, hafnium, tantalum, molybdenum, tungsten and the alloys thereof, which metal powder preparation is provided with a powder coating containing a noble metal selected from the group formed by rhenium, cobalt, nickel, ruthenium, palladium, rhodium, iridium and platinum, and the alloys thereof, and said material comprising at least one alkaline earth metal oxide selected from the group formed by calcium oxide, strontium oxide and barium oxide.

Gas discharge lamps comprising such electrodes exhibit a uniform electron emission for a long period of time, because the powder coating on the metal powder containing a noble metal causes a reaction between the alkaline earth oxide and the reducing metal to be precluded during the activation phase in the course of the manufacture of the gas discharge lamp. The reducing metal only diffuses through the powder coating of a noble metal, thereby reducing the alkaline earth oxide to elementary alkaline earth metal, when the gas discharge lamp is in operation. As a result of continuous alkaline earth dispensation, exhaustion of the electron emission is precluded, and the release of metallic alkaline earth in a sufficient quantity during the entire operation of the lamp is ensured. The emission current is homogeneous and uniform, and the service life of the gas discharge lamp is extended.

The electrodes used in these gas discharge lamps are also resistant to poisoning. The reject rate in the manufacturing process is small as these electrodes can be manufactured in a readily reproducible manner.

In accordance with a preferred embodiment of the gas discharge lamp, a second electrode coating of a noble metal selected from the group formed by rhenium, cobalt, nickel, ruthenium, palladium, rhodium, iridium, platinum is arranged between the carrier and the first electrode coating. Such a gas discharge lamp has a reduced ignition time, the electrode accommodated in such a lamp has a low work function and an improved conductivity.

It may be preferred that the metal powder preparation is made from a powder of a tungsten-iridium alloy with a powder coating of iridium.

It may also be preferred that the electron-emitting material additionally comprises zirconium oxide.

In accordance with another preferred embodiment, the metal powder preparation has an average grain size d in the range from 2.0 $\mu m \leqq d \leqq 3.0$ $\mu m$.

These and other aspects of the invention will be apparent from and elucidated with reference to the embodiment(s) described hereinafter.

DETAILED DESCRIPTION OF THE INVENTION

Figure 1:
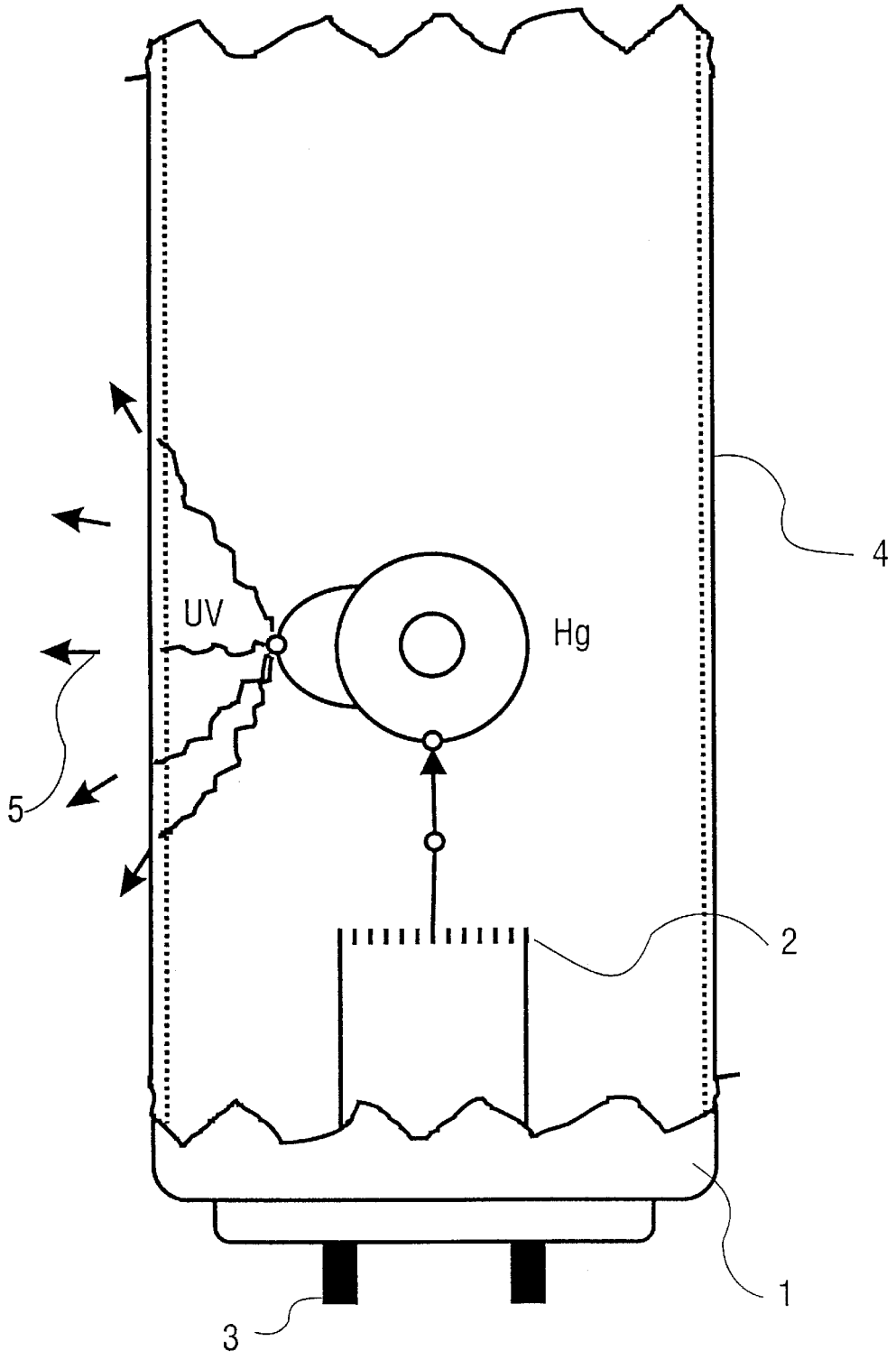
FIG. 1 diagrammatically shows the generation of light in a fluorescent lamp.

Gas discharge lamps can be divided into low-pressure lamps and high-pressure lamps. They differ in the way in which the discharge is stabilized. FIG. 1 shows, by way of example, a low-pressure discharge lamp with a mercury filling, i.e. a fluorescent lamp. Such a gas discharge lamp is composed of a rod, ring or U-shaped glass tube 1. At the ends:of the tube there are electrodes 2. For the connection use is made of dual-pin caps 3. The inner surface of the glass tube is provided with a phosphor layer 4, the chemical composition of which determines the spectrum of the light or its chrominance. Apart from an inert gas filling of argon, the glass tube contains a small quantity of mercury or mercury vapor which, when rendered luminescent under operating conditions, emits the Hg resonant line at a wavelength of 253. 7 nm in the ultraviolet range. The emitted UV radiation excites the phosphors in the phosphor layer, thereby causing them to emit light in the visible range 5.

The lamp also comprises means for igniting and for operating, for example a fluorescent lamp ballast and a starter.

A gas discharge lamp comprises an electron-emitting electrode, which includes a carrier of an electrode metal and a first electrode coating of an electron-emitting material.

The carrier of an electrode metal is customarily made of tungsten or a tungsten alloy, possibly with a molybdenum core, molybdenum, niobium, tantalum and the alloys thereof. The carrier may alternatively be composed of nickel, platinum, silicon, magnesium, aluminum or the alloys thereof. The carrier may be in the form of a wire, a coil, an undulated wire, a tube, a ring, a plate or a tape. The carrier is customarily heated directly by the current flow.

The carrier of an electrode metal may be provided with a coating of a noble metal selected from the group formed by rhenium, cobalt, nickel, ruthenium, palladium, rhodium, iridium, platinum. Preferably, the coating is a 0.1 to 2 $\mu m$ thick iridium or rhenium layer.

The raw material for the electron-emitting material is applied to this carrier. To prepare the raw material, the carbonates of the alkaline earth metals calcium, strontium and barium are ground and, if necessary, mixed with each other and with zirconium metal powder. The weight ratio of calcium carbonate:strontium carbonate:barium carbonate:zirconium typically is 25.2:31.5:40.3:3. In addition, a metal powder of the metals of the group formed by aluminum, silicon, titanium, zirconium, hafnium, tantalum, molybdenum, tungsten, and the alloys thereof, is provided with a metal of the group formed by rhenium, rhodium, palladium, iridium and platinum having a powder coating of a noble metal such as rhenium, nickel, cobalt, ruthenium, palladium, rhodium, iridium or platinum. Preferably, a metal powder having an average grain size of 2 to 3 $\mu m$ with a 0.1 to 0.2 $\mu m$ thick powder coating is used.

For the powder coating method use can be made of CVD methods, such as fluid-bed CVD. This coated metal powder is added to the raw material.

The raw material may additionally be mixed with a binder. Subsequently, the raw material is applied to the carrier by means of brushing, dip coating, cataphoretic deposition or spraying.

The coated electrodes are sealed in the end portions of the lamp. The electrodes are formed during evacuating and filling the lamp. The electrode wire is heated to a temperature in the range from 1000° C. to 1200° C. by direct passage of current. At this temperature, the alkaline earth carbonates are converted, while releasing CO and $CO_2$, to alkaline earth oxides, and then form a porous sintered body. After this "burning-off" of the electrodes, the activation process is carried out, which serves to supply excess elementary alkaline earth metal intercalated into the oxides. Said excess alkaline earth metal is formed by the reduction of alkaline earth metal oxide. In the actual reduction activation process, the alkaline earth oxide is reduced by the released CO or by the carrier metal. In addition, a current activation takes place, which is attained by the required free alkaline earth metal by electrolytic processes at high temperatures.

The finally formed electron-emitting material can preferably contain 2 to 20% by weight of a metal powder preparation. The zirconium oxide content may range between 0 and 10 wt. %.

EXAMPLE 1

A triple-coiled tungsten wire is coated with rhenium in a layer thickness of 1 $\mu m$. For the electron-emitting coating, tungsten powder having an average grain size of 3 $\mu m$ is coated with a 0.1 $\mu m$ thick rhenium layer by means of a fluid-bed CVD process. Triple carbonate composed of calcium carbonate, strontium carbonate and barium carbonate in a weight ratio of 1:1.25:1.6, is mixed with 3 wt. % zirconium metal powder, 10 wt. % of the rhenium-coated tungsten powder and with a binder preparation of cellulose nitrate and butylacetate. This emission mass is brushed onto the rhenium-coated tungsten wire, whereafter said wire is introduced into a lamp bulb and heated to 1000° C. When the electrode is being baked out, the carbonates of the alkaline earth metals convert to their oxides and the zirconium metal powder converts to zirconium oxide. Immediately after this burn-in process, an activation process may be carried out by means of reduction activation or current activation. Such a lamp has a short ignition time, the emitter electrode has a;low work function of 1.42 eV and a conductivity which is improved by a factor of 2.

EXAMPLE 2

A triple-coiled tungsten wire is coated with rhenium in a layer thickness of 1 $\mu m$. For the electron-emitting coating, tungsten powder having an average grain size of 3 μm is coated with a 0.1 μm thick rhenium layer by means of a fluid-bed CVD process. Triple carbonate composed of calcium carbonate, strontium carbonate and barium carbonate in a weight ratio of 1:1.25:1.6, is mixed with 3 wt. % zirconium metal powder, 10 wt. % of the rhenium-coated tungsten powder and with a binder preparation of cellulose nitrate and butylacetate. This emission mass is brushed onto the rhenium-coated tungsten wire, whereafter said wire is introduced into a lamp bulb and heated to 1000° C. When the electrode is being baked out, the carbonates of the alkaline earth metals convert to their oxides and the zirconium metal powder converts to zirconium oxide.

Such a lamp has a short ignition time, the emitter electrode has a low work function of 1.42 eV and its conductivity is improved by a factor of 2.

The invention has been described by means of a fluorescent lamp, however, the scope of the invention is not limited to this type of gas discharge lamps, and the invention can also be applied to, for example, other low-pressure gas discharge lamps.

What is claimed is:

1. A gas discharge lamp comprising an electrode including a carrier of an electrode metal and a first electrode coating of an electron-emitting material, which material comprises a metal powder preparation of a powder of a reducing metal of a tungsten-iridium alloy, which metal powder preparation is provided with a powder coating of iridium, said material comprising at least one alkaline earth metal oxide selected form the group consisting of calcium oxide, strontium oxide and barium oxide.

2. A gas discharge lamp as claimed in claim 1, wherein a second electrode coating of a noble metal selected from the group consisting of rhenium, cobalt, nickel, ruthenium, palladium, rhodium, iridium, platinum is arranged between the carrier and the first electrode coating.

3. A gas discharge lamp as claimed in claim 1, wherein the metal powder preparation has an average grain size d in the range from $2.0\ \mu m \leqq d \leqq 3.0\ \mu m$.

4. A gas discharge lamp comprising an electrode including a carrier of an electrode metal and a first electrode coating of an electron-emitting material, which material comprises a metal powder preparation of a powder of a reducing metal selected from the group consisting of aluminum, silicon, titanium, zirconium, hafnium, tantalum, molybdenum, tungsten and the alloys thereof, which metal powder preparation is provided with a powder coating containing a noble metal selected from the group consisting of rhenium, cobalt, nickel, ruthenium, palladium, rhodium, iridium and platinum, and the alloys thereof and wherein said reducing metal further comprises zirconium oxide, and said material comprising at least one alkaline earth metal oxide selected from the group consisting of calcium oxide, strontium oxide and barium oxide.

5. A gas discharge lamp as claimed in claim 4, wherein a second electrode coating of a noble metal selected from the group consisting of rhenium, cobalt, nickel, ruthenium, palladium, rhodium, iridium and platinum is arranged between the carrier and the first electrode coating.

6. A gas discharge lamp as claimed in claim 4, wherein the metal powder preparation has an average grain size d in the range from $2.0\ \mu m \leqq d \leqq 3.0\ \mu m$.

* * * * *